US007318525B2

(12) United States Patent
Dickinson

(10) Patent No.: US 7,318,525 B2
(45) Date of Patent: Jan. 15, 2008

(54) STACK OF BAGS INCLUDING FRONT AND REAR TABS

(75) Inventor: Adam Dickinson, Lichfield (GB)

(73) Assignee: EPS (FZC) (GB)

( * ) Notice: Subject to any disclaimer, the term of this patent is extended or adjusted under 35 U.S.C. 154(b) by 144 days.

(21) Appl. No.: 10/504,439

(22) PCT Filed: Feb. 12, 2003

(86) PCT No.: PCT/GB03/00652

§ 371 (c)(1),
(2), (4) Date: Feb. 3, 2005

(87) PCT Pub. No.: WO03/068619

PCT Pub. Date: Aug. 21, 2003

(65) Prior Publication Data

US 2005/0121351 A1 Jun. 9, 2005

(30) Foreign Application Priority Data

Feb. 12, 2002 (GB) ..... 0203347.0
Dec. 19, 2002 (GB) ..... 0229555.8

(51) Int. Cl.
*B65D 1/34* (2006.01)
*B65D 33/10* (2006.01)
*B65B 67/04* (2006.01)

(52) U.S. Cl. ..... 206/554; 248/100; 383/9

(58) Field of Classification Search ..... 206/554, 206/494; 383/7–9, 37; 248/97–100
See application file for complete search history.

(56) References Cited

U.S. PATENT DOCUMENTS 4,493,419 A * 1/1985 Prader et al. ..... 206/554
5,184,728 A * 2/1993 Wile ..... 206/554
5,335,788 A 8/1994 Beasley et al.
5,562,580 A 10/1996 Beasley et al.
5,860,529 A 1/1999 Smithson et al.
5,941,392 A * 8/1999 Huang et al. ..... 206/554
6,098,806 A * 8/2000 Mills ..... 206/554
6,179,126 B1 1/2001 Smithson et al.

(Continued)

FOREIGN PATENT DOCUMENTS

EP 0 562 889 A2 9/1993

(Continued)

*Primary Examiner*—Bryon P. Gehman
(74) *Attorney, Agent, or Firm*—Barnes & Thornburg, LLP

(57) ABSTRACT

In a stack of vest-style carrier bags S, each bag (10) comprises a front layer and a rear layer of flexible plastics material joined at the base (14) and sides (16, 18) and defining an open mouth end (20). Handles (22, 24) extend from the open mouth end. A tab (32*a, b*) extends from each ply of material between the handles. An attachment block (26) is provided between the handles (22, 24) and the handles are separably attached to the block by perforated lines of weakening. Front and rear tabs (32*a*) are separably attached to the attachment block. The rear tab (32*b*) of one bag is also separably attached to the front tab of the next bag in the stack so as to effect pulling of the front tab of the next bag from the stack. A container C is also provided for the stack with an opening O for allowing the bag to be removed and the subsequent front tab to protrude therethrough.

24 Claims, 7 Drawing Sheets

U.S. PATENT DOCUMENTS

Figure 1:
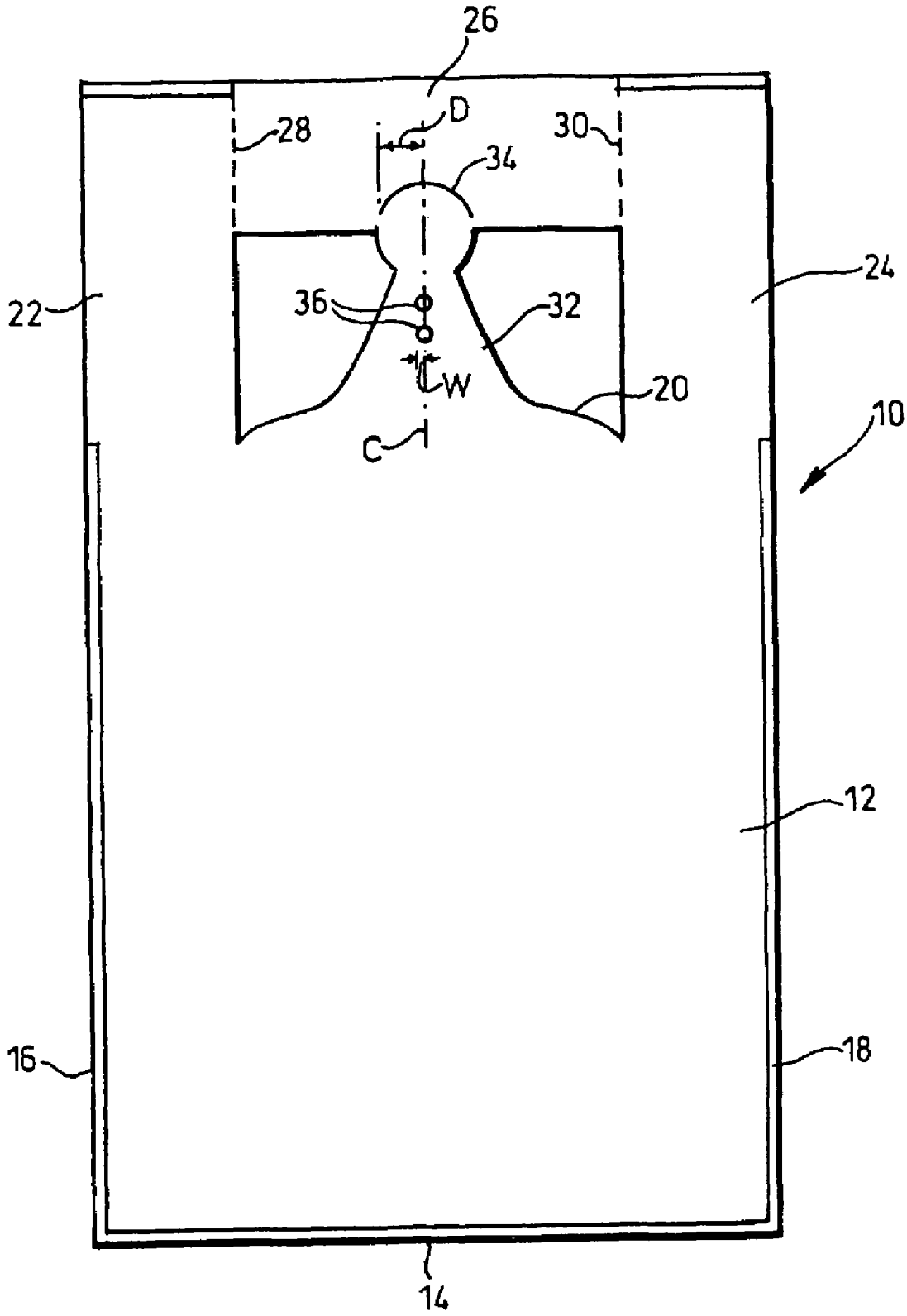

| | | | | |
|---|---|---|---|---|
| 6,655,546 | B1 * | 12/2003 | Bolton et al. | 206/554 |
| 6,716,296 | B2 * | 4/2004 | Chum | 206/554 |
| 2002/0079247 | A1 | 6/2002 | Wilforng, Jr. | |
| 2002/0185405 | A1 | 12/2002 | Chum | |

FOREIGN PATENT DOCUMENTS

| | | |
|---|---|---|
| EP | 1 219 544 A2 | 7/2002 |
| FR | 2602490 | 8/1986 |
| GB | 2 329 171 | 3/1999 |

* cited by examiner

STACK OF BAGS INCLUDING FRONT AND REAR TABS

The invention relates to a stack of bags, particularly but not exclusively limited to use in a retail establishment at the point of sale for packaging purchased goods.

Stacks of bags are commonly provided in retail establishments at the point of sale to allow the customer to package purchased goods. Such bags are generally made of thin walled, flexible plastics material and are sealed at the base end and the sides leaving the upper end open to form the mouth of the bag. There are various designs of such bags. However, one common configuration has two handle members extending from the mouth, one on each side of the bag. That configuration is known as a "vest bag" or "vest-style bag". The present invention is concerned with vest-style bags.

It is known from our earlier British patent application number 2332422 to provide a stack of vest-style bags in a dispenser, handles of the bags in the stack being separably connected to opposite ends of an attachment block of bag material. It is also known to provide a tab of material extending from the attachment block to the mouth of the bag, the tab being separably attached to the open end of the bag adjacent the mouth of the bag, which supports the middle part of the bag and prevents sagging. It is also known to bond, in semi-permanent manner, the rear face of a top bag in a stack to the front face of the subsequent bag so that, on pulling of the top bag from the stack, the front face of the next bag is pulled forward. Such bags are adhered together at a point between the mouth of the bag and the base. The problem with such bags is that, if left for a while between bag removals, the front face tends to relax back to a position flush with the rear face. Secondly, it is not obvious to a user where the bag should be pulled to effect removal.

It is an object of the invention to provide an improved stack of bags.

According to the invention there is provided a stack of vest-style bags, each bag comprising a front layer and a rear layer of flexible sheet material, the layers defining a bag body having a closed base end, closed sides and an open mouth end opposite the base end, and two handle parts spaced from each other and extending from the open mouth end, the front layer further defining a front tab extending from the open mouth end from a point between the two handle parts, the rear ply further defining a rear tab extending from the open mouth end from a point between the two handle parts, the stack of bags having attachment means to which the spaced apart handles of the bags in the stack are separably attached by lines of weakening at respective handle attachment points spaced from the mouth of each bag, the front and rear tabs being separably attached to the attachment means by lines of weakening at respective tab attachment points spaced from the open mouth end of each bag, the rear tab of one bag in the stack being separably attached to the front tab of the subsequent bag in the stack.

In that way, when a user pulls the front tab of a first bag, the handles and rear tab of the bag become detached. The rear tab of the first bag remains attached to the front tab of the subsequent bag in the stack. Further pulling of the front tab of the first bag opens the mouth of the first bag and detaches the front tab of the subsequent bag from the attachment means, pulling that front tab forwardly. Only then does the rear tab detach from the subsequent front tab. Thus the front tab of the subsequent bag is pulled forward for ready use and the withdrawn bag is removed from the stack open and ready to use.

The provision of a tab protruding from the mouth of the bag makes a much more obvious pulling point for the user. The configuration of the inventive bag provides reliable withdrawal of bags from the stack every time. Also, the stack of bags does not rely on any particular mounting configuration to function.

Each bag may be made from an elongate tube, sealed along the base and cut to define handles, a mouth and the tabs. Alternatively, each bag may comprise two plys of material, sealed along the base and the side edges and cut to define the handles, a mouth and the tabs.

The attachment means preferably comprises a block of bag material, most preferably a block comprising multiple layers of bag material. The lines of weakening by which the handles and the tabs are attached to the attachment means preferably comprise lines where the bag material is cut through, leaving only a small area connected. The attachment between the rear and subsequent front tabs is effected, preferably by means of an adhesive. Alternatively, the tabs can be locally deformed so that the material of the rear tab is pushed into a depression formed in the front tab of the next bag. In a particularly preferred embodiment, where the tabs are attached together by local deformation, one or both of the rear surface of the rear tab and the front surface of the front tab are treated to enhance the adhesion of the tabs together when locally deformed. The treatment is most preferably an electrostatic discharge treatment, known as a "Corona" treatment which renders the surface "rougher" at a microscopic level. By applying the Corona treatment to the relevant surfaces of the tabs, then locally deforming the tabs, appropriate adhesion is provided without the use of adhesive. Still further, the tabs can be punched through, the punching providing the semi-permanent attachment. In a further embodiment, the tabs may be spot-welded together, although that is less preferred than the aforementioned methods as it is a more intensive process.

Where the tabs are connected to the attachment means by lines of weakening in which a small portion remains attached, the portion which remains attached is preferably arranged a greater distance from the longitudinal centreline of the tab than the furthest extent of the attachment between the rear and subsequent front tabs. In that way, when load is applied to the rear tab, load is taken initially by the tab to tab attachment but subsequent loading tends to cause the tab to bend up around the tab to tab attachment and load the tab to attachment means attachment. In that way failure of that attachment is encouraged before failure of the tab to tab attachment.

The stack may be retained, in use, so as to hang from the attachment means. In one such embodiment, a peg, pin or plate extends through a suitable aperture in the attachment means. Alternatively, a support member is received beneath the attachment means in the gap between the attachment means and the mouth of the bag.

Although the stack of bags can be used simply by securing the attachment means, it can be useful to mount the bags in a container.

In a preferred embodiment, the stack of bags is received in a container and the container has an aperture which is arranged to allow the front tab of the top bag to protrude therefrom and, on removal of the top bag from the stack, allows the top bag to be removed open and the subsequent front tab to be pulled through the aperture. The container may be a box or a bag defining the aforesaid aperture and, preferably, includes means to retain the attachment means in the container.

In an alternative embodiment, the stack of bags may be retained on an open stand.

The front tab of each bag preferably includes a marking or markings indicating that the user should pull the tab to remove the bag from the stack.

Figure 2A:
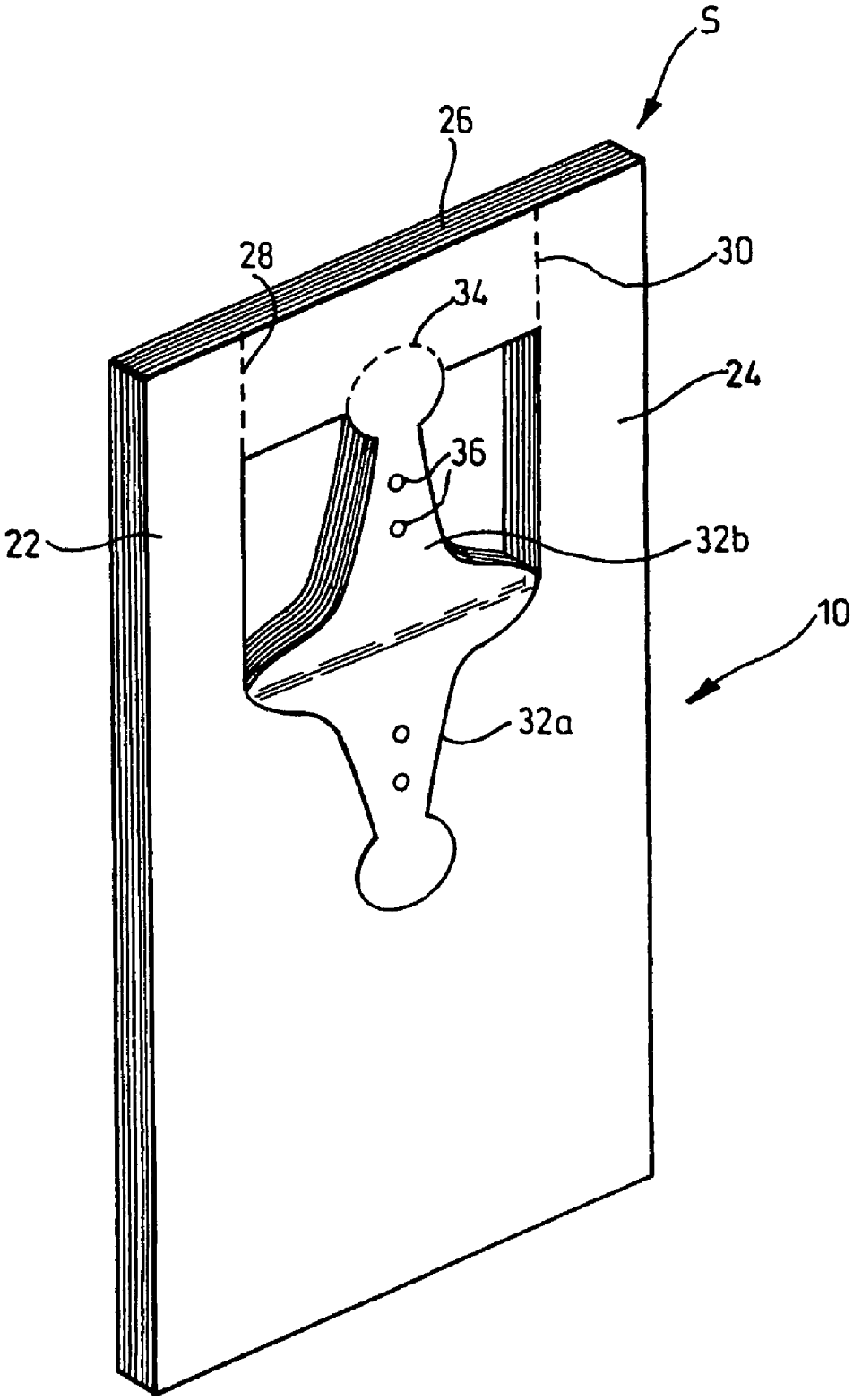
Figure 2B:
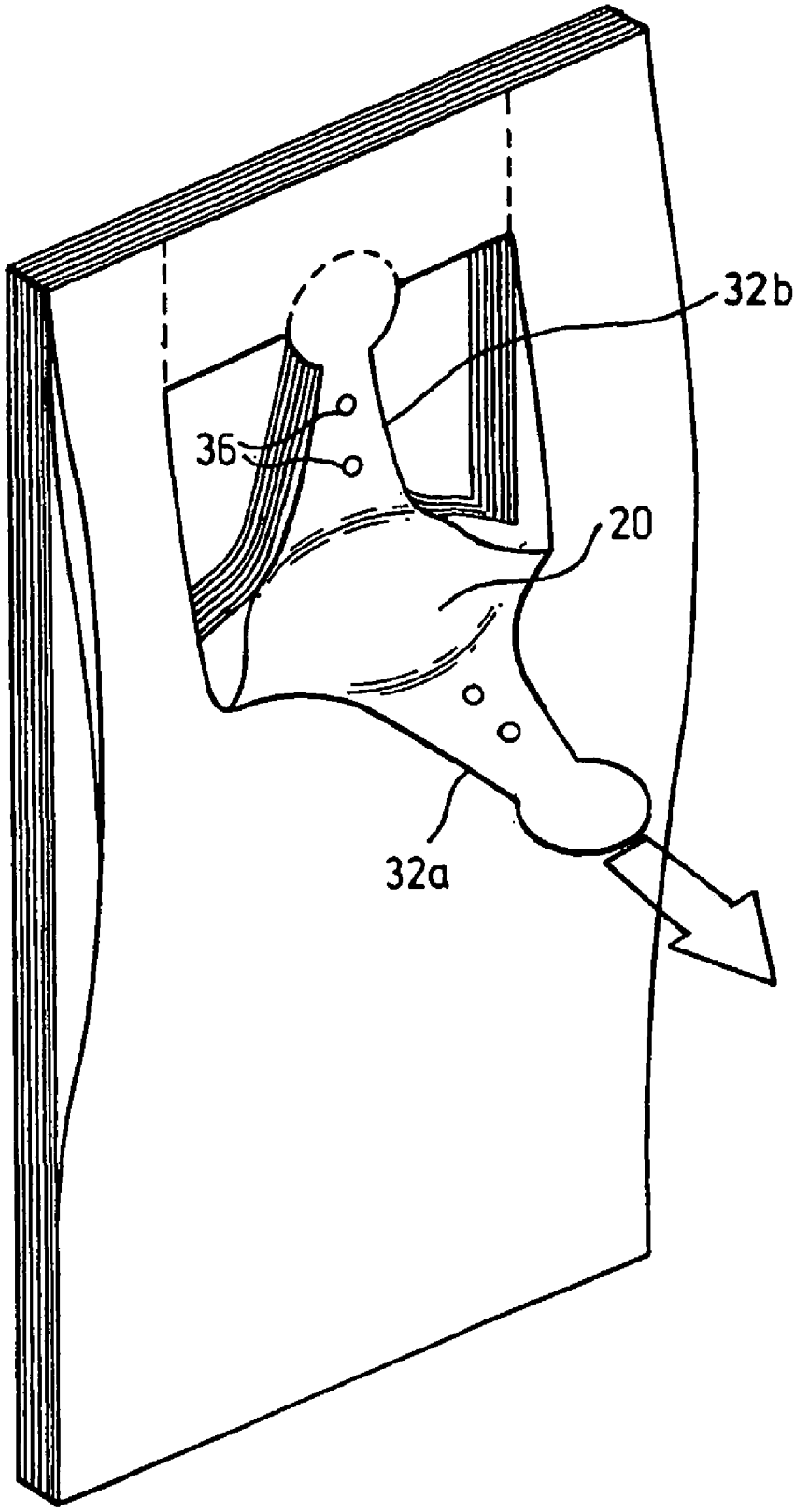
Figure 2C:
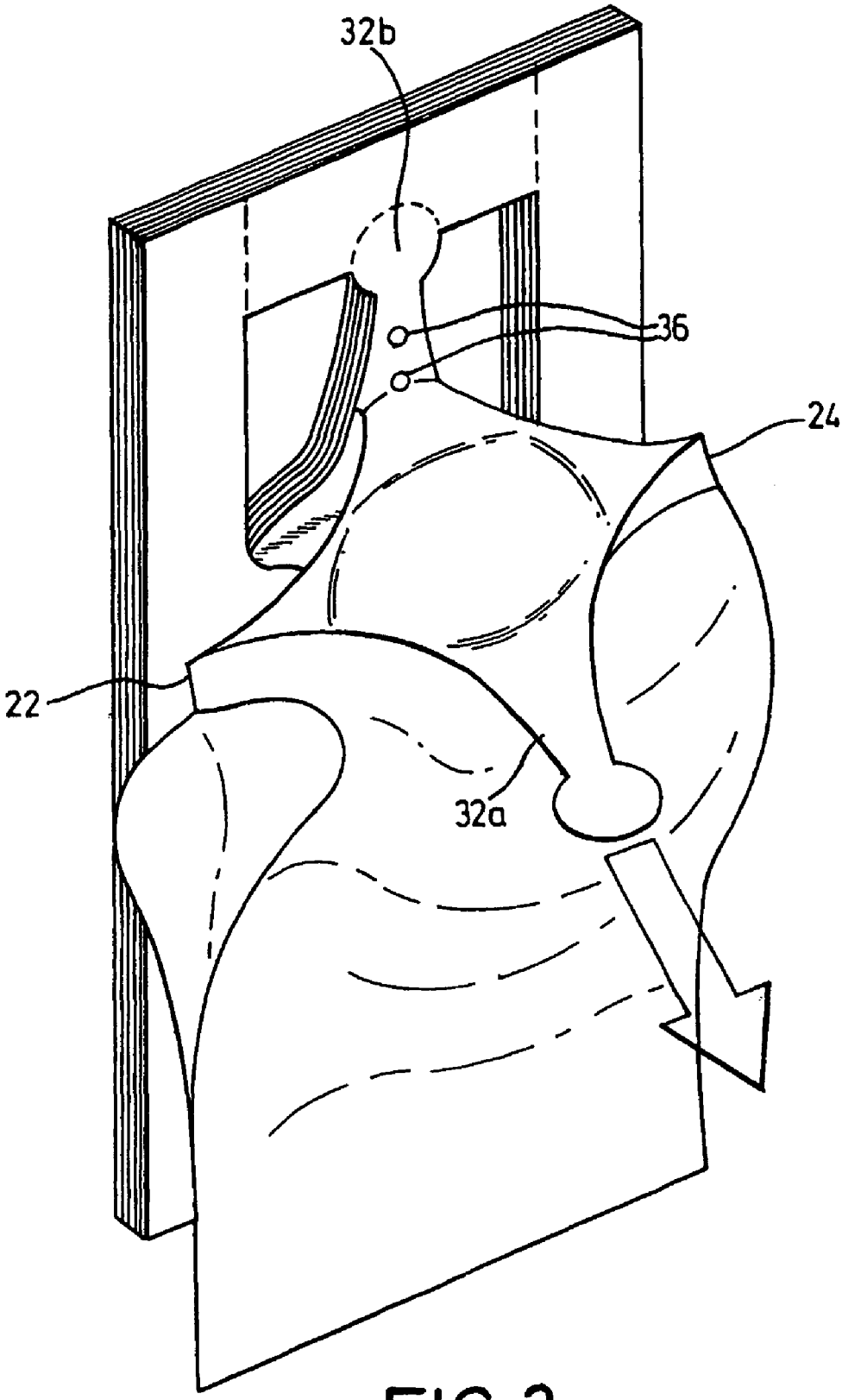
Figure 2D:
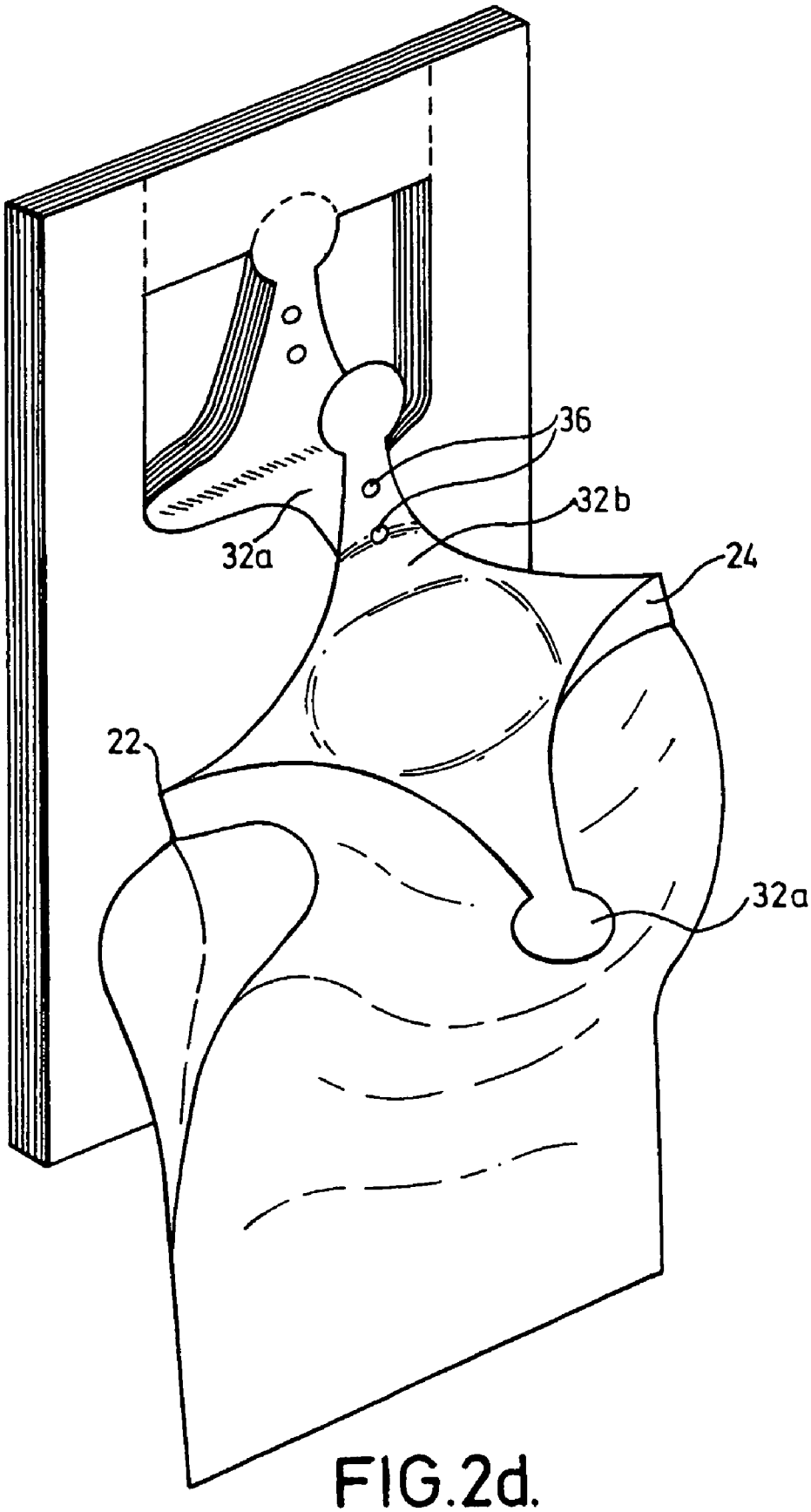
Figure 3:
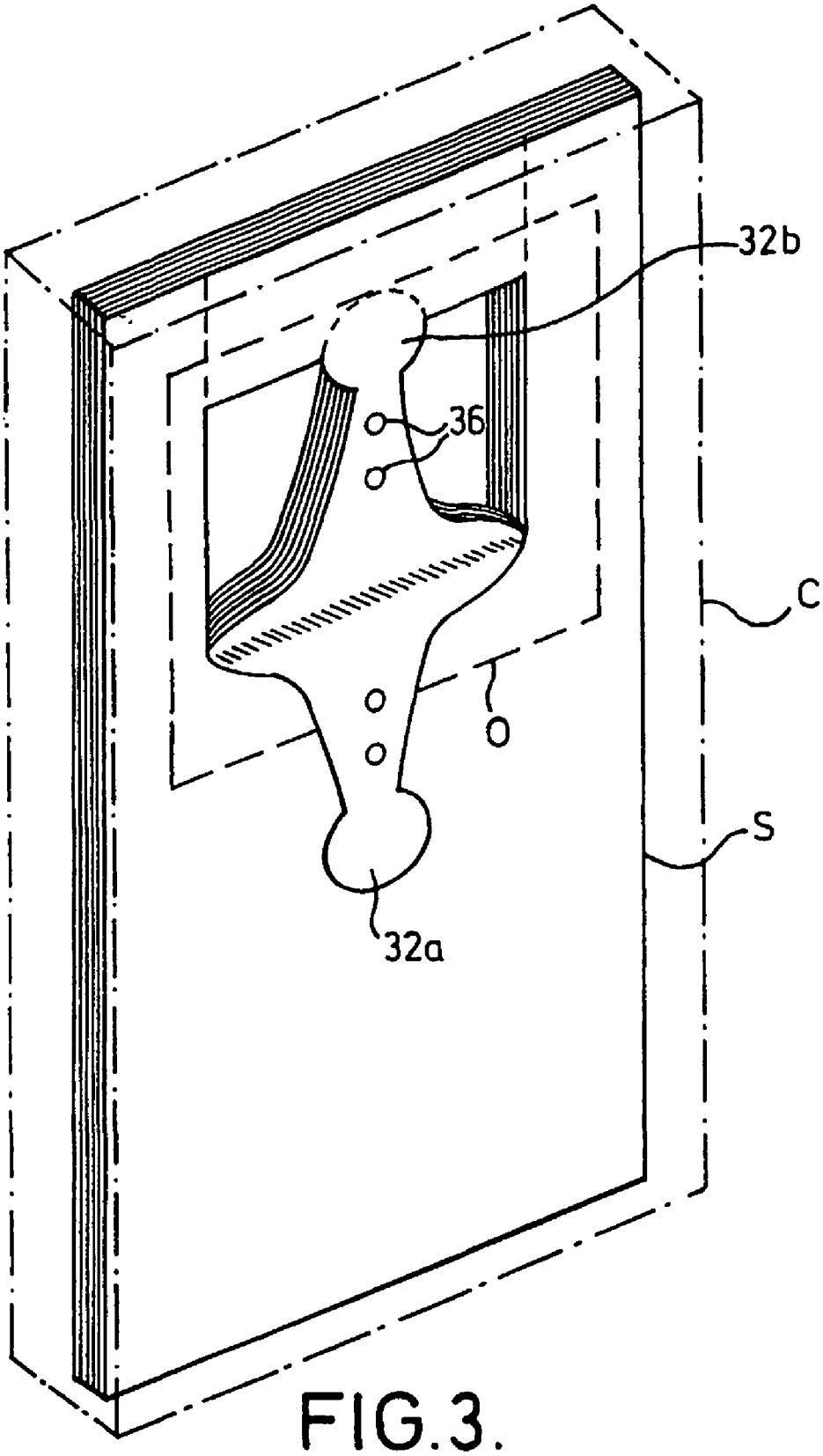
Figure 4:
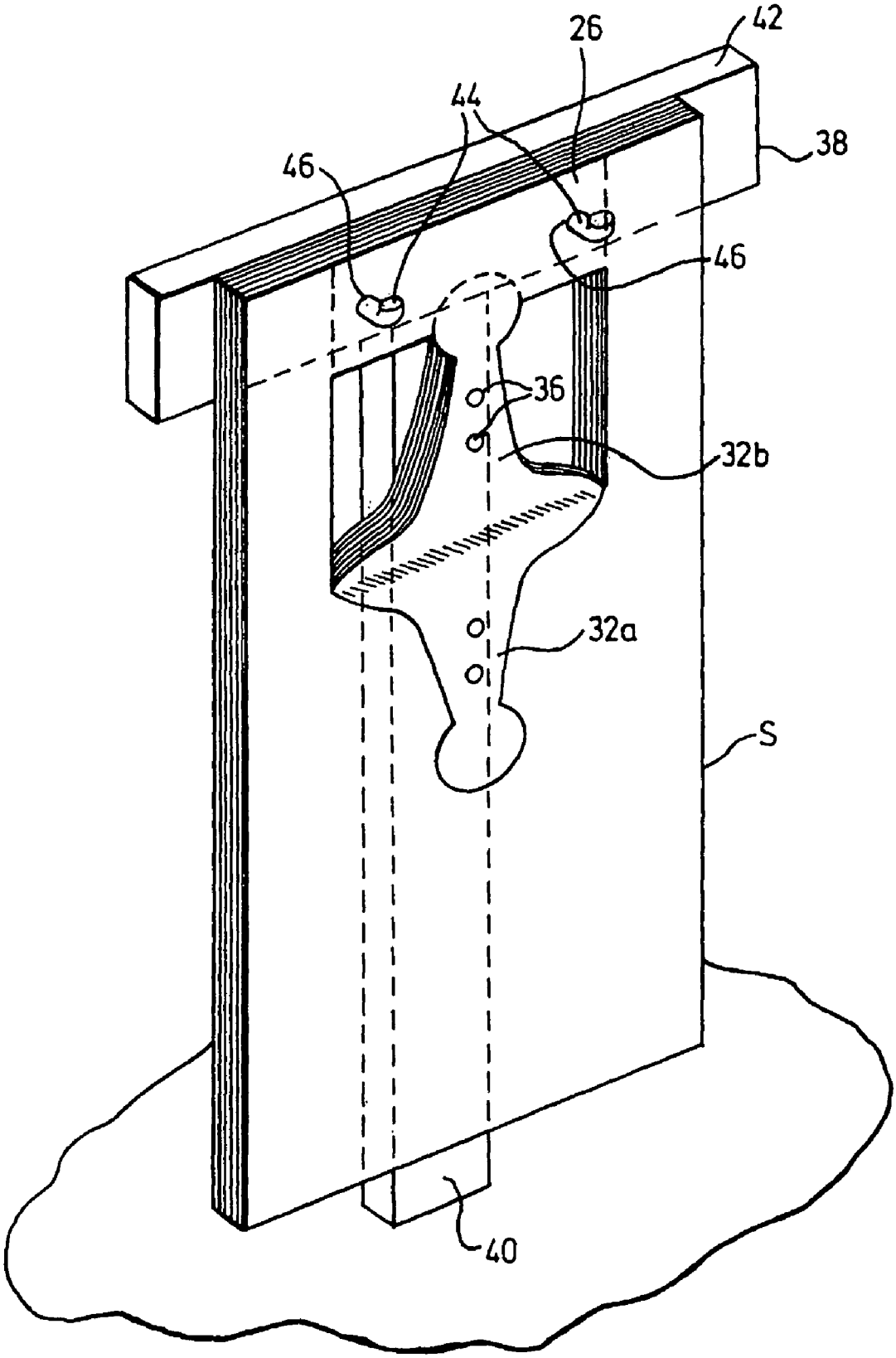

The stack of bags in accordance with the invention will now be described in detail by way of example and with reference to the accompanying drawings, in which;

FIG. 1 is a plan view of a bag for use in a stack in accordance with the invention, FIG. 2*a* is a perspective view of a stack of bags in accordance with the invention, FIG. 2*b* is a similar view to FIG. 2*a* with the front tab of the leading bag pulled outwardly, FIG. 2*c* is a similar view to FIGS. 2*a* and *b* with the front tab pulled further outwardly and the handles released from the attachment means, FIG. 2*d* is a similar view to FIGS. 2*a-c* with the front tab pulled still further outwardly so that the rear tab and the front tab of the subsequent bag are disengaged from the attachment means, FIG. 3 is a perspective view of a first container for a stack of bags in accordance with the invention, the container being shown in broken lines, and FIG. 4 is a perspective view of a second container for a stack of bags in accordance with the invention.

In FIG. 1, a bag 10 for use in a stack of bags S in accordance with the invention comprises a bag body 12 having a closed base end 14, closed sides 16, 18 and an open mouth end 20. Handles 22, 24 extend from the mouth 20 along opposite sides 16, 18 of the bag. The bag body 12 is formed from two plys of material which are joined together in the regions illustrated by means of crosshatching in FIG. 1 so as to close the base and sides of the bag. The unjoined portions on opposite sides in the handle regions 22, 24, provide the apertures through which the user can insert a hand to lift the bag.

The handles 22, 24 are attached along the upper part of their respective inner edges to a bar block 26 of bag material. The attachment is effected by serrated attachments 28, 30 respectively represented by broken lines in FIG. 1.

On each ply of material, a tab of material 32*a, b* extends from the mouth 20 of the bag to the bar block 26 and is attached to the bar block 26 by means of a similar serrated attachment 34. By way of manufacture of the bag, two rectangular sheets of thin walled flexible plastics material are arranged one on top of the other. The sides and base are sealed, by for example by welding in the regions indicated. The cut out portions between the bar block 26 and the mouth 20 are cut away using appropriate cutting apparatus and the attachment lines 28, 30, 34 between the handles 22, 24, the tabs 32 and the bar block 26 are formed by cutting through the border between the relative features and the bar block 26 in a serrated fashion. It will be noted that in the serrated attachment of the tabs 32 to the bar block 26, the innermost attachment point between tab 32 and bar block 26 is a distance D from the centreline C of the tab 32.

Thus, each bag 10 comprises a bag body 12 with handles 22, 24 and front and rear tabs 32*a*, 32*b*. The handles 22, 24 and front and rear tabs 32*a*, 32*b* are separably attached to the bar block 26.

When the stack is formed, the rear tab 32*b* of each bag is separably attached to the front tab 32*a* of the next bag in the stack at tab to tab attachment points 36 between the mouth 20 and the bar block 26.

The tab to tab attachment is preferably formed generally centrally of the tab 32. The outermost extend of the tab to tab attachment points 36 from the centreline C of each tab is a distance W. The distance W is less than aforesaid distance D.

The attachment 36 of each rear/front pair of tabs 32*b*, 32*a*, together is preferably stronger than the attachment of the tabs 32*b*, 32*a* to the bar block. In that way, the tabs 32*b*, 32*a* are guaranteed to pull away from the bar block 26 before becoming separated from each other. Alternatively, the attachment 36 may be stronger than some of the serrated attachment points between tabs 32*a, b* and bar block 26 so as to generate a progressive failure of the serrations prior to the tabs separating. Theoretically, as long as the attachment 36 between tabs 32*a, b* exceeds the strength of one of the serrated attachment points, a progressive failure could be initiated. However, that arrangement would fail less reliably than the other aforesaid versions. As shown in the figures, the attachment 36 comprises two attachment points 36*a, b* which are spaced apart slightly along the tabs 32*a, b,* one above the other. That arrangement provides a fail safe whereby failure of the first attachment point 36*a* does not result in the two tabs from becoming separated until the front tab 32*a* of the subsequent bag 10 has been detached from the bar block 26. In the embodiment shown the attachment between respective rear 32*b* and front 32*a* tabs is effected by locally deforming the material of the tab so that part of the tab material of each rear tab 32*b* is received within a corresponding depression in each subsequent front tab 32*a*. The rear surface of each rear tab 32*b* and the front surface of each front tab 32*a* has a roughened surface at a microscopic level, having received multiple Corona electrostatic discharge treatments prior to formation of the bag. Optionally an adhesive may be used in addition to local deformation. The other attachment methods mentioned above may be used.

FIGS. 2*a* to *d* illustrate a bag removal operation from a stack S. In FIG. 2*a*, the stack S is in its initial position with a front tab 32*a* of a first bag 10 in the stack S hanging down. In order to remove a bag from the stack, a user pulls the tab 32*a* away from the stack as illustrated in FIG. 2*b*. At first, pulling of the tab 32*a* opens the mouth 20 of the bag. Further pulling of tab 32*a* places the serrated attachment lines 28, 30 which join handles 22, 24 to bar block 26, under stress. Those attachment lines are designed to fail in a controlled way so that the handles 22, 24 are pulled away from the bar block 26 without comprising the integrity of the handles. The controlled failure is effected by selecting the width and number of attachments along the serrated attachment lines 28, 30. As the lines 28, 30 fail, the bag 10 is pulled further away from the stack S, further opening the mouth 20 of the bag.

As the bag is pulled open the pulling of front tab 32*a* briefly loads the attachment points 36*a, b* attaching rear tab 32*b* and subsequent front tab 32*a* together. Further pulling of the tab 32*a* pulls the subsequent front tab 32*a* away from the subsequent rear tab and the attachment line 34 comes under stress. The rear tab 32*b* and subsequent front tab 32*a* tend to fold up about the centreline C of each tab 32 because of the generally central location of the tab to tab attachment points 36. Due to the folding and the fact that distance D is greater than W, the innermost attachment points of the tab to bar block are loaded. The attachment lines 34, which join rear tab 32*b* and subsequent front tab 32*a* to the bar block 26, then fail so that the rear tab 32*b* and the subsequent front tab 32*a* come away from the bar block 26. The tabs 32*b* and 32*a* are now only connected together by the attachment points 36*a, b*. Still further pulling of the front tab 32*a* causes these attachment points 36 to be stressed and then to fail. Thus the first bag in the stack is pulled open from the stack and the front tab 32*a* of the subsequent bag 10 is pulled forwardly of the stack to indicate to a user that it should be pulled in order to remove the next bag from the stack.

As stated above, the front tab 32*a* of each bag includes indicia to indicate to a user that it should be pulled to withdraw a bag from the stack.

The tabs 32*a, b* serve a useful purpose after bag removal as ties for the bag. When conventional carrier bags are loaded in the luggage compartment of a car and a car journey is undertaken, the contents of the bags can spill out. Some users take to tying the bag handles together but that can result in compromise of the handle function and an overly firm closure which can be difficult to untie. Using the tabs as ties leaves the handles unaffected and provides a more appropriate closure.

In FIG. 3, the stack S of bags from FIGS. 2*a* to 2*d* is arranged in a container c shown in broken lines. The container is large enough to envelop the entire stack S and has an opening O formed in a front face at an upper part thereof. The opening O is dimensioned and arranged so that the front tab 32*a* of the bag hangs out of the opening O. When the stack S is located in the container C, the only part of each bag presented for pulling is the tab 32*a*. That prevents inappropriate removal which could cause failure of the stack. When a bag is removed by pulling of the front tab 32*a*, the operation described above ensures that the front tab 32*a* of the subsequent bag 10 is pulled out through opening O to provide an obvious bag removal part. The container may be made from metal, plastics material, card, paper, board or wood or any combination thereof. The container C may receive a stack of bags S folded transversely between the mouth 20 and the base end 14 so as to provide a more compact container.

In FIG. 4, the stack S is retained on a stand 38. The stand 38 is arranged at the checkout of a retail establishment. The stand 38 comprises a leg 40 with a cross member 42 extending perpendicularly across the top of the leg 40 so that the stand is "T" shaped. Hooks 44 extend from a front face of the cross member 42, one on each side of the leg 40.

In order to mount the stack S on the stand 38, two holes 46 are punched through the bar block 26 and the stack S is mounted on the stand by pushing the hooks 44 through the respective holes 46.

The present invention provides a more effective bag removal function in a stack of bags which provides a single open bag removed from the stack for each bag removal operation and which leaves the stack ready for the next bag removal.

Other tab and attachment geometries and methods may be selected within the scope of the invention.

The invention claimed is:

1. A stack of vest-style bags, each bag comprising a front layer and a rear layer of flexible sheet material, the layers defining a bag body having a closed base end, closed sides, an open mouth end opposite the base end, and two handle parts spaced from each other and extending from the open mouth end, the front layer further defining a front tab extending from the open mouth end from a point between the two handle parts, the front tab being sufficiently long to allow it to hang down from the open mouth end toward the closed base end, the rear layer further defining a rear tab extending from the open mouth end from a point between the two handle parts, the stack of bags having attachment means to which the spaced apart handles of the bags in the stack are separably attached by lines of weakening at respective handle attachment points spaced from the mouth of each bag, the front and rear tabs being separably attached to that attachment means by lines of weakening at respective tab attachment points spaced from the open mouth end of each bag, the rear tab of each bag in the stack being separably attached to the front tab of a subsequent bag in the stack.

2. A stack of vest-style bags according to claim 1 in which each bag is made from an elongate tube, sealed along the base end and cut to define handles, a mouth and the tabs.

3. A stack of vest-style bags according to claim 1 in which each bag comprises two plys of material, sealed along the base end and side edges and cut to define the handles, a mouth and the tabs.

4. A stack of vest-style bags according to claim 1 in which the attachment means comprises a block of bag material, comprising multiple layers of bag material.

5. A stack of vest-style bags according to claim 1 in which the lines of weakening by which the handles and the tabs are attached to the attachment means comprise lines where the bag material is cut through, leaving only a small area connected.

6. A stack of vest-style bags according to claim 5 in which a portion which remains attached is arranged a greater distance from a longitudinal centreline of the tab than the furthest extent of the attachment between the rear and subsequent front tabs.

7. A stack of vest-style bags according to claim 1 in which the attachment between the rear and subsequent front tabs is effected by means of an adhesive.

8. A stack of vest-style bags according to claim 1 in which the tabs can be locally deformed so that the material of the rear tab is pushed into a depression formed in the front tab of the next bag.

9. A stack of vest-style bags according to claim 8 in which one or both of the rear surface of the rear tab and the front surface of the front tab are treated to enhance the adhesion of the tabs together when locally deformed.

10. A stack of vest-style bags according to claim 9 in which the treatment is an electrostatic discharge treatment.

11. A stack of vest-style bags according to claim 1, in which the stack is retained, in use, so as to hang from the attachment means.

12. A stack of vest-style bags according to claim 11 in which a peg, pin or plate extends through a suitable aperture in the attachment means.

13. A stack of vest-style bags according to claim 11 in which a support member is received beneath the attachment means in the gap between the attachment means and the mouth of the bag.

14. A stack of vest-style bags according to claim 1 in which the stack of bags is received in a container and the container has an aperture which is arranged to allow the front tab of the top bag to protrude therefrom and, on removal of the top bag from the stack, allows the top bag to be removed open and the subsequent front tab to be pulled through the aperture.

15. A stack of vest-style bags according to claim 14 in which the container may be a box or a bag defining the aforesaid aperture and includes means to retain the attachment means in the container.

16. A stack of vest-style bags according to claim 1 in which the stack of bags is retained on an open stand.

17. A stack of vest-style bags according to claim 1 in which the front tab of each bag includes a marking or markings indicating that the user should pull the tab to remove the bag from the stack.

18. A stack of vest-style bags according to claim 1 wherein abutting tab surfaces of different bags are roughened prior to deformation.

19. A stack of vest-style bags according to claim 18 wherein the roughening is by an electrostatic discharge treatment.

20. A stack of vest-style bags according to claim 1 wherein the stack has a deformation separably attaching the rear tab of each bag in the stack to the front tab of a subsequent bag in the stack.

21. A container having therein a stack of vest-style bags, each bag comprising a front layer and a rear layer of flexible sheet material, the layers defining a bag body having a closed base end, closed sides, an open mouth end opposite the base end, and two handle parts spaced from each other and extending from the open mouth end, the front layer further defining a front tab extending from the open mouth end from a point between the two handle parts, the rear ply further defining a rear tab extending from the open mouth end from a point between the two handle parts, the stack of bags having attachment means to which the spaced apart handles of the bags in the stack are separably attached by lines of weakening at respective handle attachment points spaced from the mouth of each bag, the front and rear tabs being separably attached to the attachment means by lines of weakening at respective tab attachment points spaced from the open mouth end of each bag, the rear tab of one bag in the stack being separably attached to the front tab of the subsequent bag in the stack, the container having an aperture which is arranged to allow the front tab of the top bag to protrude therefrom and, on removal of the top bag from the stack, the top bag is removed open and the subsequent front tab is pulled through the aperture.

22. A stack of vest-style bags, each bag comprising a front layer and a rear layer of flexible sheet material, the layers defining a bag body having a closed base end, closed sides, an open mouth end opposite the base end, and two handle parts spaced from each other and extending from the open mouth end, the front layer further defining a front tab extending from the open mouth end from a point between the two handle parts, the rear layer further defining a rear tab extending from the open mouth end from a point between the two handle parts, the stack of bags having attachment means to which the spaced apart handles of the bags in the stack are separably attached by lines of weakening at respective handle attachment points spaced from the mouth of each bag, the front and rear tabs being separably attached to the attachment means by lines of weakening at respective tab attachment points spaced from the open mouth end of each bag, the rear tab of one bag in the stack being separably attached to the front tab of the subsequent bag in the stack at a tab to tab attachment point, the attachment means and attachment points being arranged so that, upon removal of a bag from the stack, the handle attachment points fail before the tab to tab attachment point.

23. A stack of vest-style bags, each bag comprising a front layer and a rear layer of flexible sheet material the layers defining a bag body having a closed base end, closed sides, an open mouth end opposite the base end, and two handle parts spaced from each other and extending along their respective lengths from the open mouth end away from the bag body, the front layer further defining a front tab extending from the open mouth end to a point between the two handle parts and midway along the length of the two handle parts, the rear layer further defining a rear tab extending from the open mouth end to a point between the two handle parts and midway along the length of the two handle parts, the stack of bags having attachment means to which the spaced apart handles of the bags in the stack are separably attached by lines of weakening at respective handle attachment points spaced from the mouth of each bag, the front and rear tabs being separably attached to the attachment means by lines of weakening at respective tab attachment points spaced form the open mouth end of each bag, the rear tab of one bag in the stack being separably attached to the front tab of the subsequent bag in the stack at a tab to tab attachment point and the front and rear tabs are formed from the respective front and rear layers.

24. A stack of vest-style bags, each bag comprising a front layer and a rear layer of flexible sheet material the layers defining a bag body having a closed base end, closed sides, an open mouth end opposite the base end, and two handle parts spaced from each other and extending from the open mouth end, the front layer further defining a front tab extending from the open mouth end to a point between the two handle parts, the rear layer further defining a rear tab extending from the open mouth end to a point between the two handle parts, the stack of bags having attachment means to which the spaced apart handles of the bags in the stack are separably attached by lines of weakening at respective handle attachment points spaced from the mouth of each bag, the front and rear tabs being separably attached to the attachment means by lines of weakening at respective tab attachment points spaced form the open mouth end of each bag, the rear tab of one bag in the stack being separably attached to the front tab of the subsequent bag in the stack at a tab to tab attachment point and the front and rear tabs are formed from the same material as the respective front and rear layers.

* * * * *